US007146672B1

(12) United States Patent
Meheen

(10) Patent No.: US 7,146,672 B1
(45) Date of Patent: Dec. 12, 2006

(54) TUNABLE LOAD SHARING ARCH BRIDGE

(76) Inventor: H. Joe Meheen, 1562 S. Parker Rd., Suite 228, Denver, CO (US) 80231

( * ) Notice: Subject to any disclaimer, the term of this patent is extended or adjusted under 35 U.S.C. 154(b) by 0 days.

(21) Appl. No.: 11/233,083

(22) Filed: Sep. 23, 2005

(51) Int. Cl.
*E01D 19/00* (2006.01)

(52) U.S. Cl. ..... 14/2; 14/77.1

(58) Field of Classification Search ..... 14/2, 14/3, 4, 5, 10, 13, 14, 24, 25, 26, 77.1
See application file for complete search history.

(56) References Cited

U.S. PATENT DOCUMENTS 27,963 A * 4/1860 Bishop ..... 14/2
144,751 A * 11/1873 Evans ..... 14/13
146,397 A * 1/1874 Long ..... 14/9
187,513 A * 2/1877 Colby ..... 52/639
238,130 A * 2/1881 Lawrence ..... 14/4
762,632 A * 6/1904 Headley ..... 14/4
1,163,641 A * 12/1915 Cummings ..... 14/2
4,631,772 A * 12/1986 Bonasso ..... 14/20
4,691,399 A * 9/1987 Kim et al. ..... 14/2

* cited by examiner

*Primary Examiner*—Gary S. Hartmann
(74) *Attorney, Agent, or Firm*—Richard W. Hanes; Hanes & Schutz, LLC

(57) ABSTRACT

A method and apparatus for adjusting the live and dead load balance between the arches of an arch bridge and the truss girder that supports the bridge deck. The method is achieved by providing a tension equalizing member across the bottom chord of the truss girder whose tension may be adjusted in cooperation with tension adjustments of hanger rods disposed between the arches and the bottom chords of the truss girder.

5 Claims, 4 Drawing Sheets

TUNABLE LOAD SHARING ARCH BRIDGE

FIELD OF THE INVENTION

The present invention relates to load carrying structures and particularly arch bridges.

BACKGROUND OF THE INVENTION

Arch bridges with truss girder decks are common. The arch can be either above or below the deck with vertical members interconnecting the deck and the arch. Being in compression the arch transmits the dead and live loads on the bridge to the abutments to which the arch ends are attached. Common practice is to use the truss girder to stiffen the deck while the arch is employed as the primary load carrying member. When the arch is positioned above the bridge deck a plurality of spaced apart vertical hangers interconnect the arch and the deck, the hangers being in tension to carry the live loads on the bridge and keep the truss girder from deflecting under its own dead load.

Methods have been devised to use tension members under the bridge deck to provide an equalizing upward force on the arch hangers in order to reduce the otherwise significant structural size of the arch. However, the corresponding increase in other structural members to properly anchor or support the tension members usually offsets any cost reduction in the arch supports. Such a structure is disclosed in U.S. Pat. No. 6,892,410 for Reinforcement Structure of Truss Bridge or Arch Bridge.

Accordingly, it is the primary object of the present invention to provide a method and bridge apparatus for simplifying arch bridge construction and reducing its cost.

Another object of the invention is to provide apparatus in an arch bridge having a truss girder supported deck to balance the loads and create stability in the bridge.

A more specific object of the invention is to provide an arch bridge structure where a simple tension member will allow the truss girder that carries the bridge deck to assume the dead load of the bridge while a lighter and less costly arch structure carries the live load.

A further object of the invention is to provide an arch bridge where the tension forces in the hangers depending from the arch structure and the tension forces in supplementary tension members that span the lower portion of the truss girder can be independently adjusted to selectively vary the sharing of the live and dead loads between the arch and the truss girder.

Other and still further objects, features and advantages of the invention will become apparent upon a reading of the following description of a preferred form of the invention, taken in conjunction with the accompanying drawings.

SUMMARY OF THE INVENTION

The present invention includes apparatus integrated into the structure of an arch bridge with a truss girder deck that allows balancing adjustment of load sharing between the arch and the truss girder. At least one tension member spans the lower chord of the truss girder and the tension forces in that member may be varied by adjustment of nuts on the terminal ends of the member. Tension force within a plurality of hanger rods that depend from the arch and are connected to the lower chord of the truss girder may also be varied by adjustment of nuts on the hangers. The sharing of live and dead loads on the bridge between the arch and the truss girder may be selectively apportioned by respective tension adjustment of the spanning tension member and the hanger rods.

DETAILED DESCRIPTION OF PREFERRED EMBODIMENT

Figure 1:
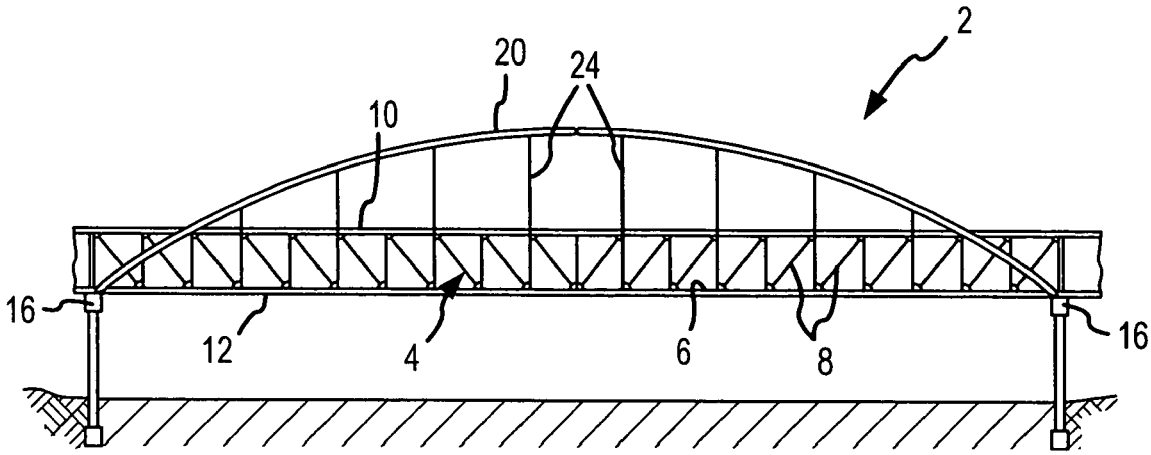
FIG. 1 is a side view of an arch bridge, having a truss girder supported deck, in which the apparatus of the present invention may be incorporated. The truss girder is fractionally shown because the girder and deck may be extended beyond the vertical piers that support and anchor the girder and the arch.
Figure 2:
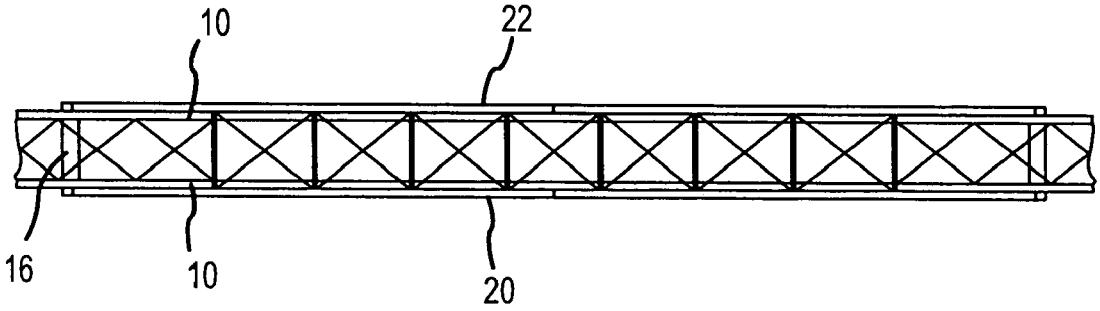
FIG. 2 is a plan view of the arch bridge of FIG. 1 showing the lateral interconnections between the spaced apart arch members.
Figure 3:
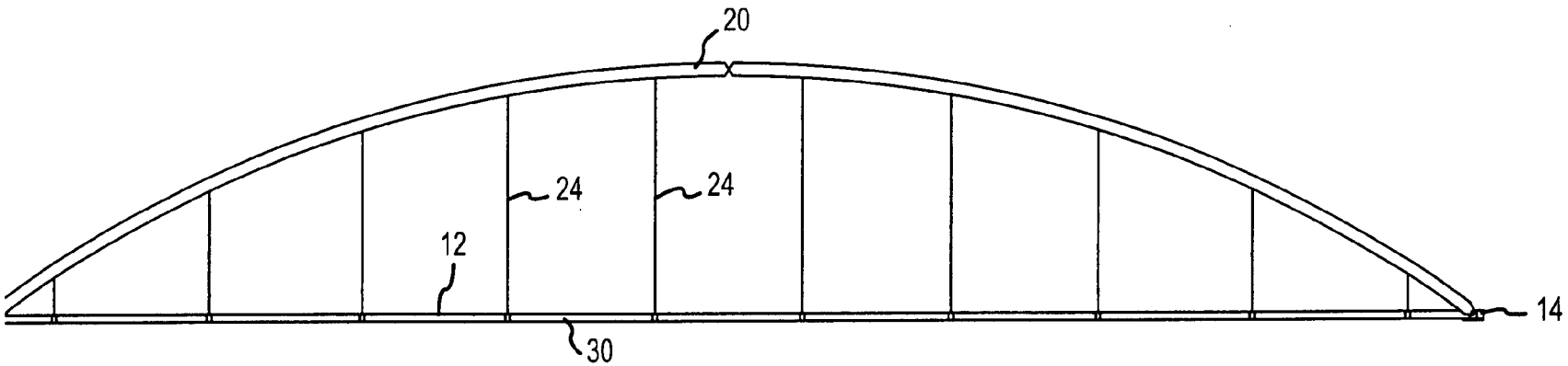
FIG. 3 is an enlarged diagrammatic side view of the arches, the depending hanger rods, the lower chords of the truss girder and the spanning tension member, all of which are the primary operative elements of the present invention.
Figure 4:
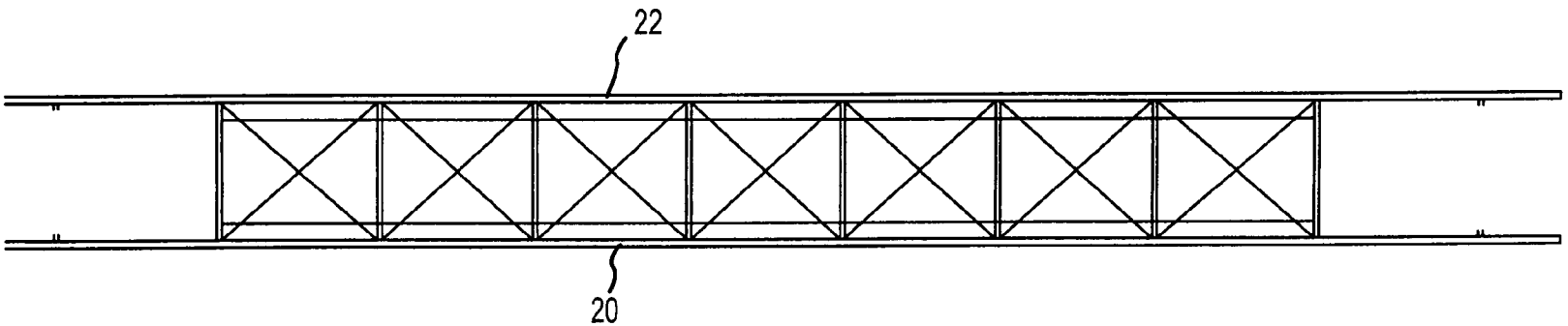
FIG. 4 is a top view of the structure shown in FIG. 3.
Figure 7:
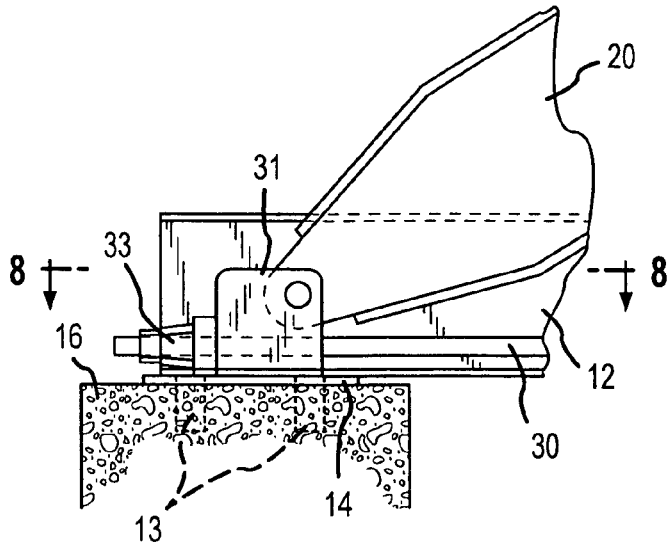
FIG. 7 is an enlarged fractional view of a typical supporting abutment illustrating the attachment thereto of the end of an arch, the end of the truss girder and the end of the spanning tension member. The figure is typical of all four abutment members, two at each end of the bridge.
Figure 8:
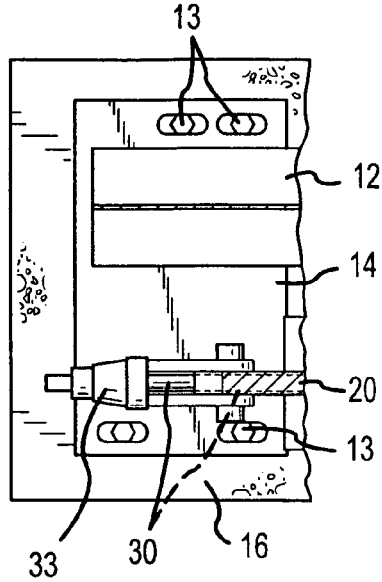
FIG. 8 is a top plan view of the structure shown in FIG. 7.
Figure 9:
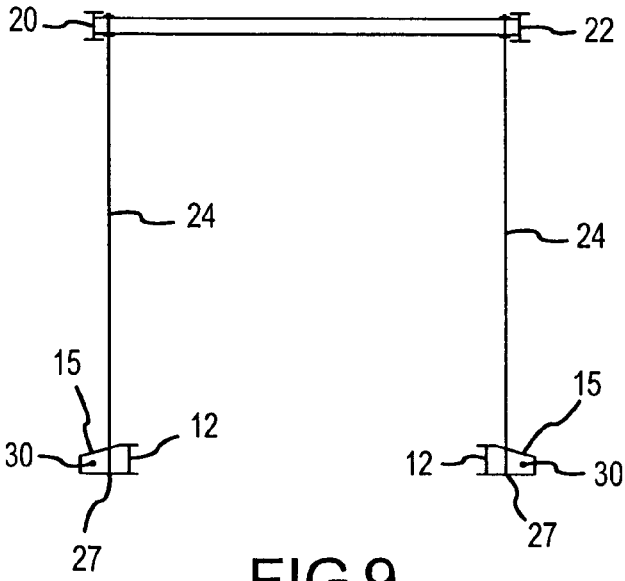
FIG. 9 is a diagrammatic end view of the structure shown in FIG. 3.

The present invention is applied to an arch bridge 2 having a box truss girder 4 that supports a deck 6 disposed along the bottom of the truss girder. The truss includes structural side members 8 and interconnecting top and bottom structural members, including laterally spaced apart top chords 10 on each side of the truss girder and laterally spaced apart bottom chords 12 on each side of the girder. Each end of each bottom truss chord 12 is attached to a bearing plate 14 that is anchored by bolts 13 or similar means to a fixed bridge abutment 16 (FIGS. 7 and 8). Also attached to each bearing plate, by a pin 29 passing through a bracket 31, are the terminal ends of laterally spaced apart bridge arches 20 and 22. At spaced apart intervals a plurality of hangers 24 depend from each of the arches (FIGS. 3 and 9). The lower ends of each hanger are connected to the bottom chords 12 of the truss deck 4 (FIGS. 5, 6 and 9).

According to the present invention, in order to balance the dead and live loads between the truss girder and the bridge arches, tension forces in the hanger rods 24 may be adjusted, in conjunction with adjustment of tension forces in separate tension rods 30 that span the lower chords 12 of the truss girder 4. The structure of these components of the invention will be described.

Figure 6:
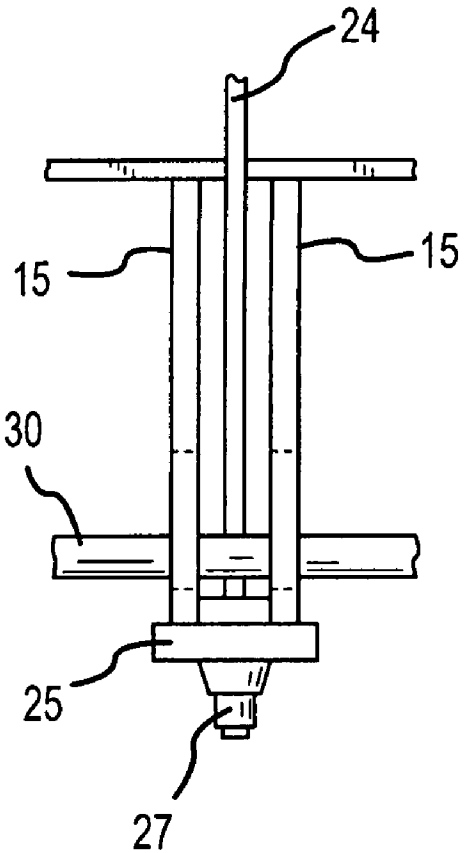
FIG. 6 is an end view of the bracket shown in FIG. 5.
Figure 5:
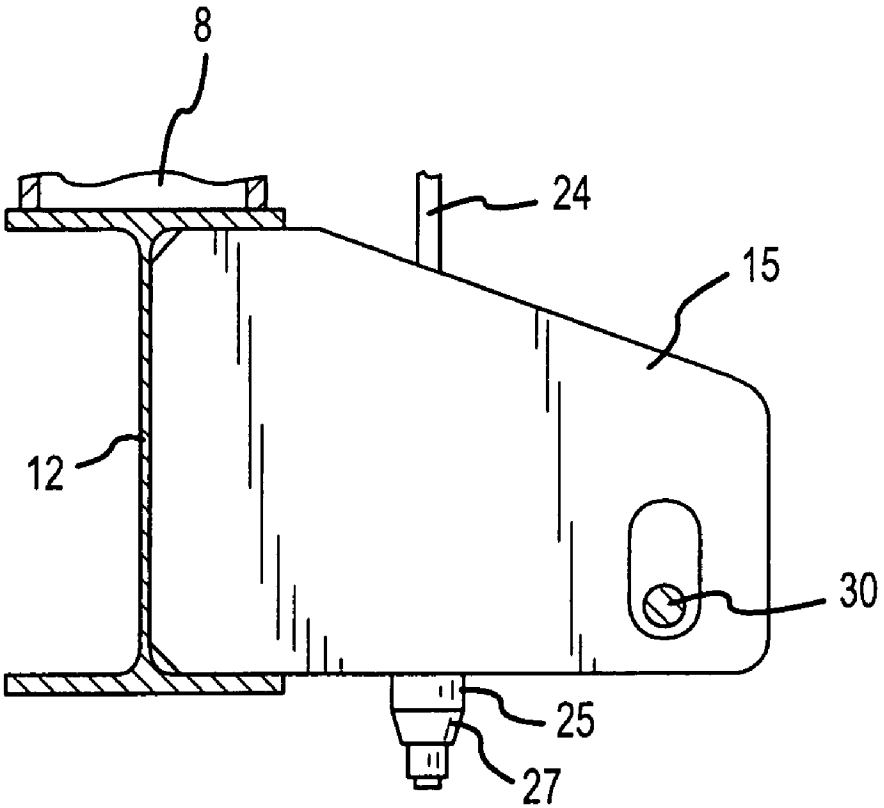
FIG. 5 is a cross sectional view of one of the lower chords of the truss girder and showing in side view the attached bracket to which the lower end of a hanger rod is fastened.

FIGS. 5 and 6 of the drawings illustrate the preferred method of attaching the hanger rods to the lower truss chord. A pair of closely spaced apart parallel brackets 15 extend laterally from and are welded to the bottom chord 12 of the truss girder. The lower end of a hanger rod 24 passes through a horizontal bearing plate 25 that spans the space between the pair of brackets 15 and abutts the lower edges of the brackets. A nut 27 attached to the threaded end of the hanger rod 24 bears against the bottom of the bearing plate 25 and secures the end of the hanger rod to the bracket. Nut 27 can be tightened or loosened to adjust the tension force in the hanger rod 24. The construction shown in FIGS. 5 and 6 is typical of the anchoring of the lower ends of the hanger rods 24.

Disposed in parallel with each of the bottom truss chords 12 and spanning each of those chords is a tension rod 30 whose terminal ends are also connected to the brackets 31 that are fixed to the bearing plates 14 that are anchored by bolts 13 to the end abutments 16 on each lateral side of the truss. Threaded rod ends of the tension rods 30 are fitted with nuts 33 that bear against the brackets 31. Tightening or loosening the nuts 33 on the ends of the rods 30 adjusts the tension force in each rod.

With the construction of the primary structural elements in mind, the operational aspects of the novel bridge combination will be addressed. When placed on the spaced apart abutments, the truss girder tends to deflect downwardly due to its own weight. Such deflection and consequent bending creates tension in the bottom chords 12 of the truss and compression forces in the top chords 10. Tightening the end nuts 33 on each spanning tension rod 30 creates tension forces in the rods that apply compressive pressure to the bottom chords of the truss, thus tending to equalize the dead load tension in those bottom chords while simultaneously relieving the dead load compressive forces in the top truss chords 10. This equalization of forces in the chords of the truss girder creates a condition where the deck truss girder is stabilized so that it carries its own dead load without significant deflection.

Live loads on the bridge deck are picked up by the tension members 24 that depend from the arches 20 and 22. Tightening the nuts 27 on the lower ends of the hanger rods 24 Increases the tension in those hangers which further decreases the dead load tension in the bottom chords of the truss girder, thus shifting part of the dead load to the arches, if necessary or desirable. On the other hand, loosening the nuts 27 and decreasing tension in the depending hangers 24 and increasing tension in the rods 30 shifts some of the live load on the bridge to the deck truss 4. By selectively varying the tension adjustments in the respective horizontal and vertical tension members 30 and 24 respectively, portions of the live and dead loads may be transferred between the bridge arches and the deck truss to optimize the sharing of loads and minimize the cost of the respective bridge elements.

What is claimed is:

1. A method of sharing live and dead loads in a bridge structure having a box truss with top and bottom chords comprising the steps of, equalizing the dead load tension in the bottom chords, providing at least one arch, the terminal ends of which are interconnected by at least one of the bottom chords, and applying tension force to a plurality of points between the at least one arch and one of the bottom chords.

2. The method of claim 1 where the equalization of the tension in the bottom chords is a function of tension force applied in at least one rod that spans at least a portion of the length of the bottom chords.

3. The method of claim 1 where the tension between the at least one arch and a bottom chord is applied through a plurality of spaced apart rods that interconnect the arch and the bottom chord.

4. The method of claims 2 or 3 and including the further step of varying the tension in the at least one rod that spans at least a portion of the length of the bottom chords.

5. The method of claim 4 and including the further step of varying the tension in the plurality of spaced apart rods that interconnect the at least one arch and the bottom chord.

* * * * *